US005277452A

United States Patent [19]

Skidmore

[11] Patent Number: 5,277,452

[45] Date of Patent: Jan. 11, 1994

[54] ALBUM WITH AUDIO TAPE PLAYER

[76] Inventor: Valerie J. Skidmore, 838 N. Jefferson, Rensselaer, Ind. 47978

[21] Appl. No.: 950,906

[22] Filed: Sep. 24, 1992

[51] Int. Cl.[5] ..... B42D 3/18; B42D 1/06

[52] U.S. Cl. ..... 281/31; 281/19.1; 281/29

[58] Field of Search ..... 281/15.1, 31, 29, 19.1; 40/159; 402/79, 80 R, 4; 206/387, 455, 449, 472

[56] References Cited

U.S. PATENT DOCUMENTS

| | | | |
|---|---|---|---|
| 3,372,858 | 3/1968 | Brody | 281/31 X |
| 3,829,132 | 8/1974 | Willieme | 281/31 |
| 4,002,355 | 1/1977 | Sendor | 281/31 X |
| 4,255,872 | 3/1981 | Williams, Sr. | 281/31 X |
| 4,649,453 | 3/1987 | Iwasawa | 206/387 X |
| 5,161,907 | 11/1992 | Byrne | 402/4 |

FOREIGN PATENT DOCUMENTS

| | | | |
|---|---|---|---|
| 2749854 | 5/1979 | Fed. Rep. of Germany | 281/31 |

*Primary Examiner*—Mark Rosenbaum
*Assistant Examiner*—Peter Dungba Vo
*Attorney, Agent, or Firm*—Woodard, Emhardt, Naughton, Moriarty & McNett

[57] ABSTRACT

A photo and memorabilia album is disclosed which includes an audio tape player. The invention contemplates a holder mounted on a cover of the photo album which is configured to retain an audio tape player therein. In one embodiment, the holder is formed by a frame which defines the compartment into which the tape player is removably placed. The holder includes openings for the speaker and for the tape access door of the tape player. In addition, a second holder mounted on the photo album cover can be provided for removably supporting an audio tape for use with a tape player.

10 Claims, 1 Drawing Sheet

ALBUM WITH AUDIO TAPE PLAYER

BACKGROUND OF THE INVENTION

The present invention concerns albums, such as photo albums. In particular, the invention contemplates combining a photo album with an audio tape player.

Nearly every family in this country has a photo album in which various photographs and other memorabilia are maintained. The albums naturally serve as a sort of historical archives for the people and events that shape a family history. Photo albums memorialize these people and events for access by future generations interested in tracing their heritage.

One drawback of photo albums is that over time the meaning behind certain photographs or memorabilia can be lost or forgotten. For example, it is not uncommon for a photograph taken at a family event to show a person whose identity has faded from memory. This problem can sometimes be solved by including a written description with each photograph in an album describing the events or/or people in the photograph. The same difficulty and possible solution surrounds memorabilia and photographs whose significance in a family history requires some explanation. It is certainly a less than optimal solution to the problem to require people preparing the album to make what could be lengthy entries within the album pages to describe the contents of the album.

One alternative to a photo album is a video tape recorder. However, video tape systems are often very expensive to own and maintain. In addition, a video tape lacks the great convenience presented by a photo album that can be reviewed easily by anybody. Moreover, even though particular events and activities can be captured more completely with a video tape, the problem still exists concerning the identity of people on the tape, or the reasons for recording the events on tape, that may be lost in the memories of the participants over time. Finally, it is considerably easier to take individual photographs of people and events, as opposed to simply videotaping every day in the life of a family.

There therefore remains a great need for some means for providing a more complete description of the photographs and memorabilia contained within a photo album. This means should be easily connected with the album for use by future generations interested in learning a little about their family heritage.

DESCRIPTION OF THE PREFERRED EMBODIMENT

Figure 1:
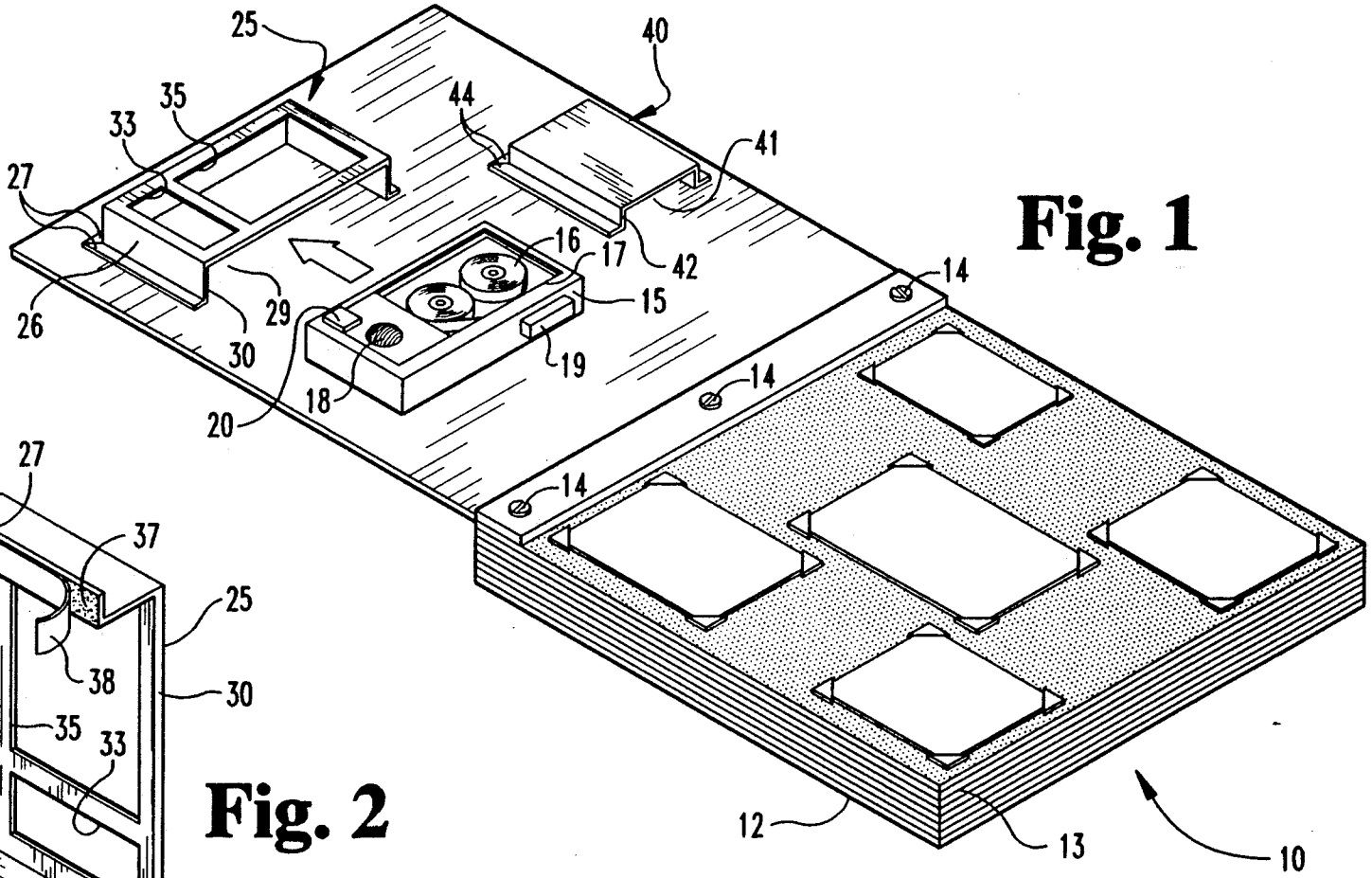
FIG. 1 is a pictorial view of a photo album with an audio tape player in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The album 10 according to a preferred embodiment includes a front cover 11, a back cover 12 and a number of pages 13. Each of the covers and pages includes a binding edge having several holes. Mounting screws 14 extend through the holes to bind each of the covers and all of the pages, and to allow periodic insertion of additional pages. In accordance with the present invention, the front cover 11 of the album 10 is modified to accommodate an audio tape player 15. The tape player is of the cassette or microcassette type which plays a cassette tape 16. The cassette tape 16 is inserted into the tape player 15 by way of an access door 17. The tape player 15 includes a speaker 18 and a playback switch 19 which controls the operation of the player. In accordance with one embodiment of the invention, the tape player 15 is simply a playback device, not having a capability for recording on the cassette tape 16. Alternatively, and more preferably, the tape player 15 has the ability to play back and record, in which case a microphone 20 is built into the tape player 15.

A central feature of the invention concerns the tape player holder 25. The holder is formed by a frame 26 which is attached to the inside face of the front cover 11 by way of a peripheral mounting flange 27. The holder 26 forms a compartment 29 which is sized to slidably receive the tape player 15 therein through an opening 30. The frame 26 defines a speaker opening 33 which is oriented over the location of speaker 18 when the tape player 15 is contained within compartment 29. In addition, the frame 26 defines a cassette access opening 35 which allows access to the cassette door 17 for insertion or removal of a cassette tape from the tape player 15. The cassette access opening 35 is naturally sized to permit opening of the cassette access door 17 of tape player 15. In the preferred embodiment, the holder 25 is open at the opening 30 so that the tape player 15 can be readily inserted and removed. Alternatively, the frame 26 may define a flap or other similar extension which can be folded down over the opening 30 to more readily hold the tape player 15 within the compartment 29.

Figure 2:
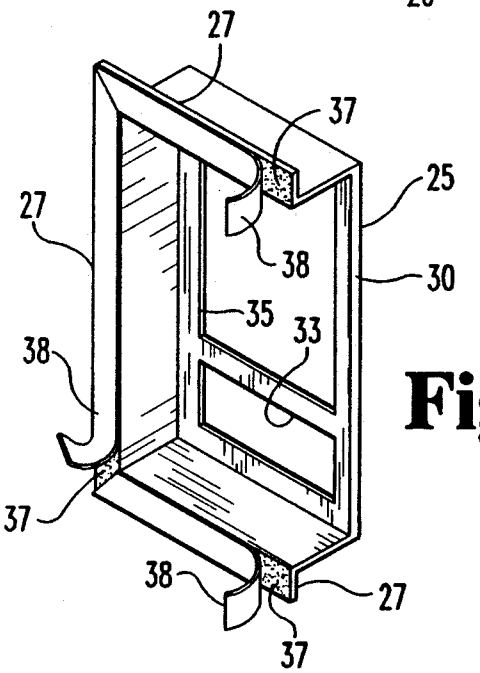
FIG. 2 is a bottom view of the audio tape player holder depicted in FIG. 1 but prior to attachment to the album cover.

In the preferred embodiment, the holder 25 is formed of a relatively rigid cardboard-type material. With this material, the holder 25 can be affixed to the album front cover 11 by way of adhesive applied at the mounting flanges 27. Alternatively, as depicted in FIG. 2, the holder 25 can include a self-adhesive feature around the mounting flanges 27. More specifically, an adhesive layer 37 can be directly applied to the underside of the flanges. A protective sheet 38 can be placed over the adhesive layer 37 on the flanges 27. The protective sheet can then be removed when it is desired to place the holder 25 on the inside of the front cover 11 of an existing album. This self-adhesive feature renders the holder 25 readily marketable as an "add-on" to an existing family photo album.

In an additional feature of the invention, a cassette holder 40 is also provided on the front cover 11. The holder 40 includes a compartment 41 sized to receive a cassette tape, such as tape 16, therein through an access opening 42. As with the tape player holder 25, the cassette holder 40 is affixed to the front cover 11 by way of peripheral mounting flanges 44. The cassette holder 40 can be formed of the same material and mounted to the front cover 11 in the same manner as the tape player holder 25. The tape 16 can be housed within the cassette holder 40, or retained in the tape player 15. In the latter case, an additional cassette tape can be stored within the holder 40. Moreover, additional cassette holders 40 can be mounted to the front cover 11.

The album 10 according to the present invention provides a significant advantage over the traditional photo album. With this invention, a cassette tape player is maintained with the album itself. Thus, the person preparing the album can spend as much time as he/she feels necessary to describe each photograph within the album. Not only does this feature allow for a much more comprehensive description, and consequently understanding, of the memorabilia and photographs in the album, but it also brings the album entries to life. The addition of the audio tape feature saves the recollections in the voice of the person narrating the description of the album entries. This feature can be particularly valuable if the narrator is deceased, since it can lend a greater sense of history to those viewing the album. Moreover, the narrator's voice and language is itself a piece of family history to be heard by future generations.

While a primary use of the album 10 of the present invention is to record a family history, the same technology can be used in a variety of other settings. For instance, the album 10 could be used as a yearbook for high school and college students. It is a well-known practice for students to have their friends make written entries in the yearbook at the end of a school year. Rather than written entries, an audio entry can be made on a cassette using the album 10 of the present invention.

In addition, the features of the present invention can be employed in business settings. For instance, a company may maintain a product brochure available to potential clients which includes a cassette tape with an audio description of the products or services described in the brochure. The utility of the present invention is easily appreciated and a wide range of other uses can be readily contemplated.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

For instance, while the preferred embodiment concerns an adhesively fixed tape player holder 25 and cassette holder 40, it is within the scope of the invention that these same holders can be integrally formed into the planar body of a separately provided cover. The cover could be configured as the front or back cover of a photo album. In this instance, the cover can replace the existing cover of the album by removing mounting screws 14 and replacing the new cover thereon.

In a further embodiment of the invention, the tape player is permanently retained within the holder 25. In this instance, access to the cassette door would be necessary. In addition, some access to allow replacement of the tape player battery would be required.

It can be seen that the present invention provides a ready means for an audio "guided tour" through the associated album. The use of the audio tape provides a personalized narration to accompany the photo album which can add a great deal of color and personal touch to any album, whether a family photo album or a business brochure.

What is claimed is:

1. An audio album combination comprising:

an album having a front cover, a back cover and a number of pages for carrying pictorial or graphic information;

an audio tape player for playing an audio tape carrying an audio description of information on said pages, said tape player having a tape access door for insertion of an audio tape into said player;

first holder means for supporting said tape player in direct association with said pages of the album, said first holder means including a first frame defining a first compartment for receiving said tape player therein, and means for mounting said first frame to a cover of said album, whereby a person viewing the album can concurrently listen to the audio tape, said first frame further defining an access opening therethrough aligned with said tape access door when said tape player is received within said first compartment, said access opening thereby allowing insertion of an audio tape into said tape access door without removing said tape player from said first holder means; and second holder means for supporting said audio tape in direct association with said tape player, said second holder means including a second frame defining a second compartment sized to removably receive an audio tape therein, and means for mounting said second frame to a cover of said album, said second holder means thereby allowing storage of said audio tape until insertion into said tape player.

2. The album according to claim 1, further comprising:

a second holder defining a second compartment sized to receive an audio tape therein, and including means for mounting said second holder to a cover of said album.

3. The album according to claim 1, wherein:

said tape player includes a speaker; and said first frame defines a speaker opening aligned with said speaker when said tape player is received within said first compartment.

4. The album according to claim 1, wherein:

said tape player includes a playback switch; and said first frame is configured to provide access to said playback switch when said tape player is received within said first compartment.

5. The album of claim 1, wherein said means for mounting includes a flange defined around a perimeter of said frame and adhesive disposed between said flange and said cover of the album.

6. The album of claim 5 wherein said means for mounting includes an adhesive layer on said mounting flange and a removable protective sheet covering said adhesive layer for removal when said holder is to be mounted on said cover of the album.

7. A replacement cover for converting an existing photo album to an audio album combination, comprising:

a substantially planar body;

means for binding said body into an existing album;

an audio tape player, said tape player having a tape access door for insertion of an audio tape into said player;

first holder means for supporting said tape player in direct association with the album, said first holder means mounted to said planar body and including a first frame defining a first compartment for removably receiving said tape player therein, said first frame further defining an access opening therethrough aligned with said tape access door when said tape player is received within said first compartment, said access opening thereby allowing insertion of an audio tape into said tape access door without removing said tape plate from said first holder means; and second holder means for supporting an audio tape in direct association with said audio tape player, said second holder means mounted to said planar body and including a second frame defining a second compartment sized to receive an audio tape therein, said second holder means thereby allowing storage of said audio tape until insertion into said tape player.

8. The replacement cover of claim 7, further comprising a second holder mounted to said planar body defining a second compartment sized to receive an audio tape therein.

9. The album according to claim 7, wherein:

said tape player includes a speaker; and said first frame defines a speaker opening aligned with said speaker when said tape player is received within said first compartment.

10. The album according to claim 7, wherein:

said tape player includes a playback switch; and said first frame is configured to provide access to said playback switch when said tape player is received within said first compartment.

* * * * *